United States Patent [19]

Nelson

[11] Patent Number: 4,493,410

[45] Date of Patent: Jan. 15, 1985

[54] DOUBLE ACTUATION COIN SLIDE SYSTEM

[75] Inventor: Robert B. Nelson, Newton, Iowa

[73] Assignee: The Maytag Company, Newton, Iowa

[21] Appl. No.: 453,875

[22] Filed: Dec. 27, 1982

[51] Int. Cl.[3] ..... G07F 5/12

[52] U.S. Cl. ..... 194/1 G; 194/9 T

[58] Field of Search ..... 194/1 G, 1 Q, 1 J, 1 M, 194/9 T, 92

[56] References Cited

U.S. PATENT DOCUMENTS

| | | | |
|---|---|---|---|
| 3,099,341 | 7/1963 | Greenwald | 194/9 |
| 3,231,059 | 1/1966 | Hall | 194/92 |
| 3,260,339 | 7/1966 | Greenwald et al. | 194/92 |
| 3,735,066 | 5/1973 | Greenwald et al. | 200/52 R |
| 3,827,541 | 8/1974 | Greenwald et al. | 194/1 L |

*Primary Examiner*—Stanley H. Tollberg
*Attorney, Agent, or Firm*—R. L. Ward

[57] ABSTRACT

A double actuation coin slide system is provided which is associated with a coin slide housing. A sequential controller is associated with the coin slide housing and is energizable for controlling a timed sequence of operations. A power source provides electrical power between a pair of conductors for energizing the sequential controller. A switch is associated with one of the electrical conductors and is actuatable for selectively connecting or disconnecting electrical power from the power source to the sequential controller. A coin slide is mounted on the coin slide housing and is movable from a coin receiving position to a position for rotationally advancing a shaft portion of the sequential controller. The coin slide is operable through a first coin slide insertion cycle for effecting actuation of the switch to disconnect the power source while conditioning the sequential controller for energization by advancing the shaft portion. The coin slide is operable through a subsequent second coin slide insertion cycle for effecting actuation of the switch to connect the power source and energize the sequential controller so that two coin slide insertion cycles are required for initiating a timed sequence of operations.

8 Claims, 5 Drawing Figures

DOUBLE ACTUATION COIN SLIDE SYSTEM

BACKGROUND OF THE INVENTION

This invention relates generally to the field of coin operated vending machines and more particularly to providing a coin slide system which requires a double actuation of the coin slide to energize a particular vending operation.

In the past, various coin slide systems have been shown which require multiple insertions of the coin slide in order to achieve actuation of the vending system. These systems have generally utilized either mechanical elements such as cam arrangements or presettable stepping switches and relays to achieve the desired number of coin slide insertions prior to system actuation.

Greenwald, U.S. Pat. No. 3,099,341, teaches a circuit having a stepping relay which may be preset to require a predetermined number of actuations of the coin slide. When the number of actuations of the coin slide equals the preset number a circuit is connected between the pair of series connected switches to effect energization of the machine.

Greenwald et al, U.S. Pat. Nos. 3,735,066 and 3,827,541, further teach systems for actuating pairs of switches. Cams are provided for actuating the switches and are conditioned to establish conduction through both switches after a given plurality of coin slide insertions. The device may also be configured to actuate both switches to a conductive condition after a single coin slide insertion so that the device is convertible from a single to a multiple slide mode of operation.

The prior art has thus shown various electrical and mechanical systems for providing multiple insertion of a coin slide or multiple coin insertions to actuate a vending operation. There has been no known showing of a coin slide mechanism which is operable for initiating a vending operation after a double insertion of the coin slide with the first insertion being operable for opening the contacts of a push-push switch while conditioning the system for a vending operation and the second insertion being operable for closing the push-push switch contacts to energize the vending operation.

SUMMARY OF THE INVENTION

It is therefore an object of the instant invention to provide an improved coin slide system.

It is a further object of the instant invention to provide a coin slide system for actuating a vending operation after a double insertion of the coin slide.

Briefly, the instant invention achieves these objects in a double actuation coin slide system associated with a housing and operable for initiating an electrically energized vending operation. A power source provides electrical power between a pair of electrical conductors for powering apparatus for effecting the vending operation. A switch is associated with one of the conductors for selectively connecting or disconnecting electrical power from the power source to the vending effecting apparatus. A coin slide is mounted on the housing and is movable from a coin receiving position to a position for initiating the vending operation. The coin slide is operable through a first coin slide insertion cycle for effecting actuation of the switch to disconnect the power source while conditioning the system for the vending operation. A second coin slide insertion cycle effects actuation of the switch to connect the power source and energize the vending effecting apparatus so that two coin slide insertion cycles are required for each vending operation.

Operation of the coin slide system and further objects and advantages thereof will become evident as the description proceeds and from an examination of the accompanying two sheets of drawings.

BRIEF DESCRIPTION OF THE DRAWINGS

The drawings illustrate a preferred embodiment of the invention with similar numerals referring to similar parts throughout the several views, wherein.

DESCRIPTION OF A PREFERRED EMBODIMENT

Figure 1:
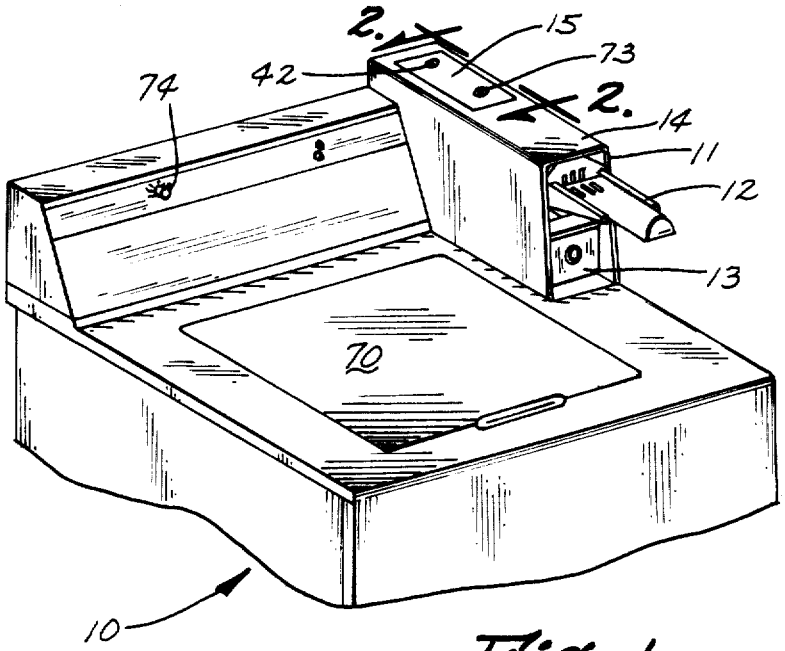
FIG. 1 is a perspective view of a coin operated commercial clothes washer.

Turning now to the drawings, there is shown in FIG. 1 a commercial washing machine 10 equipped with a housing 11 for mounting a coin slide mechanism 12. The housing 11 includes a coin vault 13 located immediately below the coin slide mechanism 12 for receiving coins. The top surface 14 of the housing 11 includes an access door 15 for providing a service entrance to the interior of the housing 11.

Figure 2:
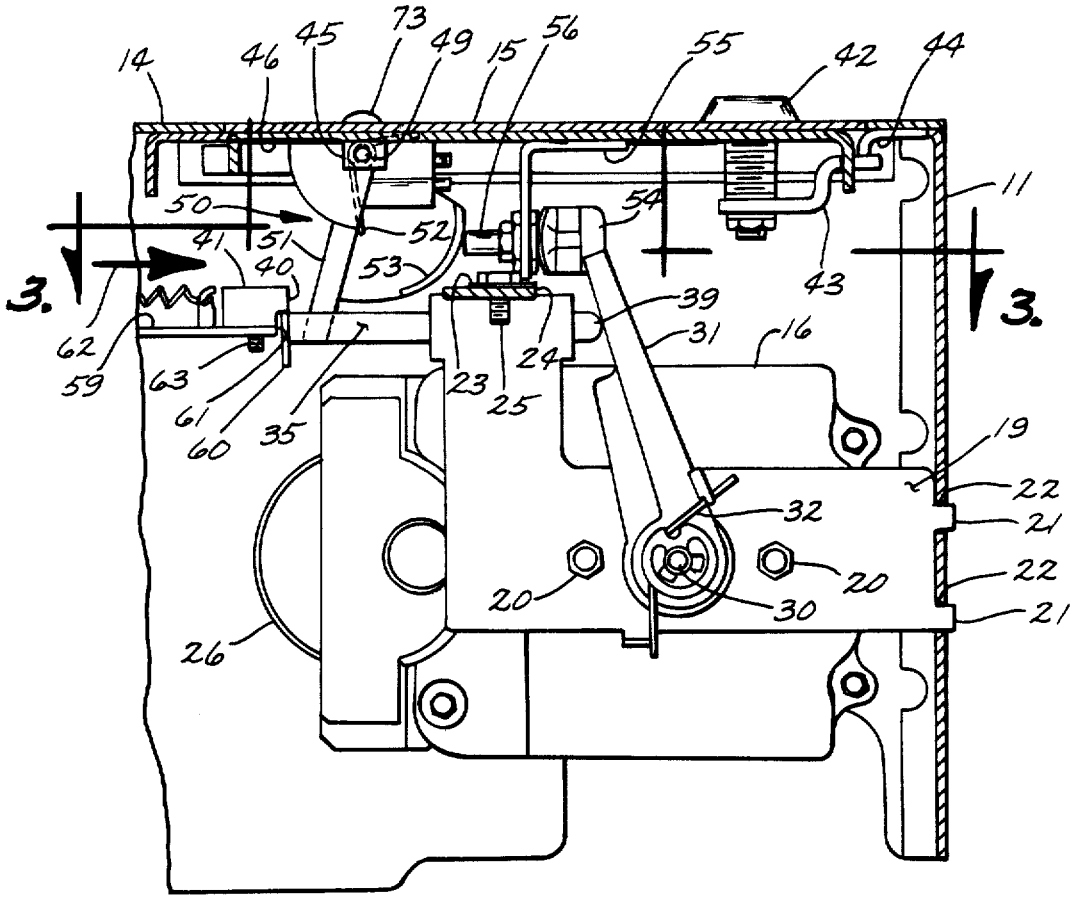
FIG. 2 is a fragmentary section view taken through the coin slide housing of the washing machine generally along lines 2—2 of FIG. 1.
Figure 3:
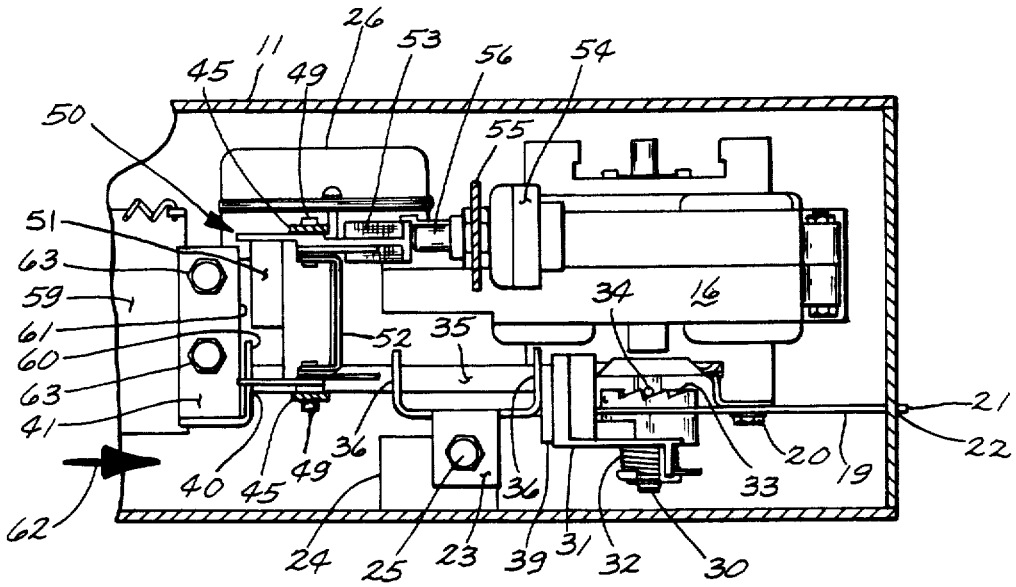
FIG. 3 is a partial fragmentary section view taken generally along lines 3—3 of FIG. 2.

Referring to FIGS. 2 and 3, there is shown in this embodiment an electromechanical timer or sequential controller 16 mounted within the housing 11 which is operable for controlling the washing machine 10 through at least one operational cycle of events including repetitions of filling the tub with water, agitating and spinning/draining for washing clothing. The housing 11, as shown in FIGS. 1-3, is generally rectangular in configuration with the rear portion, immediately below the access door 15, reserved for mounting the timer 16. As best shown in FIGS. 2 and 3, the timer 16 is bolted to a mounting bracket 19 through a pair of bolts 20. The mounting bracket 19 includes a pair of locating tabs 21 which mate with slots 22 in the rear wall of the housing 11. The mounting bracket 19 also has a flange 23 which engages with a mounting bracket 24 secured to a sidewall of the housing 11 and is fastened thereto by a thread cutting mechanical fastener 25.

In operation, the timer or sequential controller 16 is driven at a timing speed by the timer motor 26 through appropriate reduction gearing (not shown). When a cycle of operations is completed, a line switch 29 shown schematically in FIGS. 4 and 5 and located within the timer 16 will be opened. As shown in FIGS. 2 and 3, one end of the timer shaft 30 has an upwardly extending pivot arm 31 which is rotatably mounted to the timer shaft and is biased in a counterclockwise direction by a torsion spring 32. The pivot arm 31 includes a toothed segment 33 radially surrounding the timer shaft 30 which is drivingly engageable with a drive pin 34 that extends perpendicularly through the timer shaft 30. Movement of the pivot arm 31 in a clockwise direction will effect engagement of the drive pin 34 with the toothed segment 33 and rotation of the timer shaft 30 from the "off" position where the line switch 29 is open, to a position where the line switch 29 is closed and the timer 16 is conditioned for operation.

An actuator rod 35 is slidably mounted between a pair of arms 36 associated with the mounting bracket 19 with one end 39 engageable with the pivot arm 31 and the other end 40 engageable with the actuator 41 of the coin slide mechanism 12.

The access door 15 shown in FIGS. 1 and 2 is removable from the housing 11 by inserting a key (not shown) into the lock 42 and rotating the key to, in turn, rotate the locking lug 43 away from the downwardly turned lip 44 of the housing 11. As best shown in FIGS. 2 and 3, a pair of downwardly turned spaced-apart flanges 45 are formed from the inner plate 46 of the access door 15. These spaced-apart flanges 45 each have an aperture for receiving a press-fit roll pin 49.

An actuation lever 50 is pivotally mounted on the roll pins 49 between the flanges 45. This actuation lever 50 includes a downwardly extending leg portion 51 which is aligned with the actuator 41 of the coin slide mechanism 12. The actuation lever 50 is biased in a clockwise direction by a torsion spring 52 which mounts on the roll pins 49 as best shown in FIG. 3. Further included in the actuation member 50 is a radial cam portion 53 which is operable for engaging with and actuating a push-push switch 54 as the actuator lever 50 is pivoted by the actuator 41 of the coin slide mechanism 12. The cam portion 53 is designed so that once the push-push switch 54 has been actuated further partial insertions of the coin slide mechanism 12 at the end of the stroke and prior to engagement of the coin slide ratchet mechanism (not shown) will not allow the push-push switch 54 to reset. The push-push switch 54 will be reset only as the coin slide mechanism 12 is returned to the coin receiving position.

The push-push switch 54 is mounted on a right angle bracket 55 secured to the inner plate 46 of the access door 15. The actuator button 56 of this switch 54 is engageable with the cam portion 53 of the actuator lever 50 as shown in FIGS. 2 and 3.

The coin slide mechanism 12 mounted on the housing 11 includes an internal slide extension 59 to which the actuator 41 is attached, as best shown in FIGS. 2 and 3. The actuator 41 is formed from sheet metal and includes a substantially vertically disposed wall segment 60 which is positioned for engagement with the end 40 of the actuator rod 35 associated with the timer 16. An edge portion 61 of the actuator 41 is operable for contacting the leg portion 51 of the actuation lever 50 and for pivoting the actuation lever 50 as the coin slide mechanism 12 is advanced in the direction of the arrow 62 in FIGS. 2 and 3. The actuator 41 is secured to the slide extension 59 by a pair of threaded fasteners 63.

Figure 4:
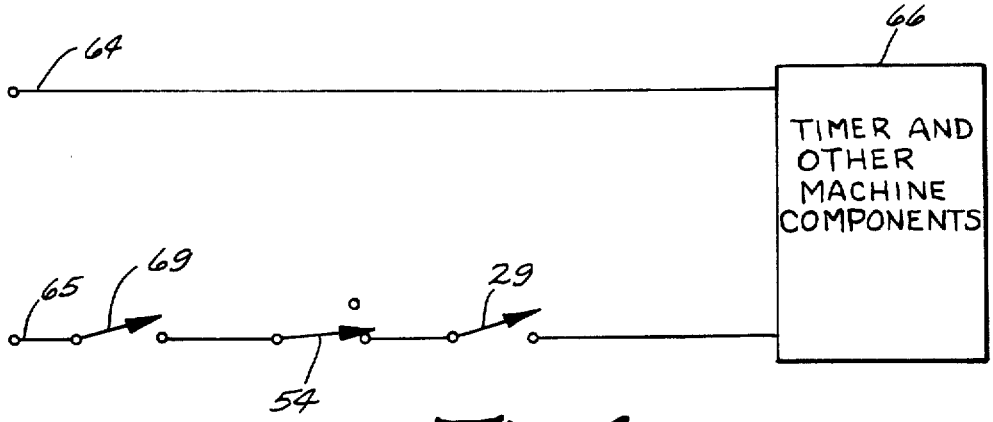
FIG. 4 is a partial schematic drawing of the circuitry for the washing machine and showing the switching arrangement thereof.

The electrical schematic of FIG. 4 depicts a preferred embodiment of the instant invention. In this embodiment, several switches are required to be closed before the washing machine 10 will be operational. In FIG. 4, 120 VAC line voltage is provided between conductors 64 and 65. Conductors 64 and 65 are connected across a load which is schematically depicted by the rectangle 66 and includes the timer, drive motor, valves, dispensers and other electrical machine components.

Conductor 65 schematically shows a number of switches including a lid switch 69, the push-push switch 54 and the line switch 29 located physically within the timer 16. In the case of the washing machine 10 of FIG. 1, the lid switch 69 is closed when the access lid 70 is closed. For purposes of definition, the push-push switch 54 which is mounted on the access door 15 of the housing 11 is defined as a switch having an actuator which moves to a position upon application of an actuating force and remains there after removal of the force. Application of a second actuating force is required to return the actuator to its original position. In this embodiment, the original position of the push-push switch 54 is a contact closed position. As previously discussed herein, the line switch 29 associated with the timer 16 is energized when the pivot arm 31 is rotated in a clockwise direction to condition the timer 16 for operation.

Figure 5:
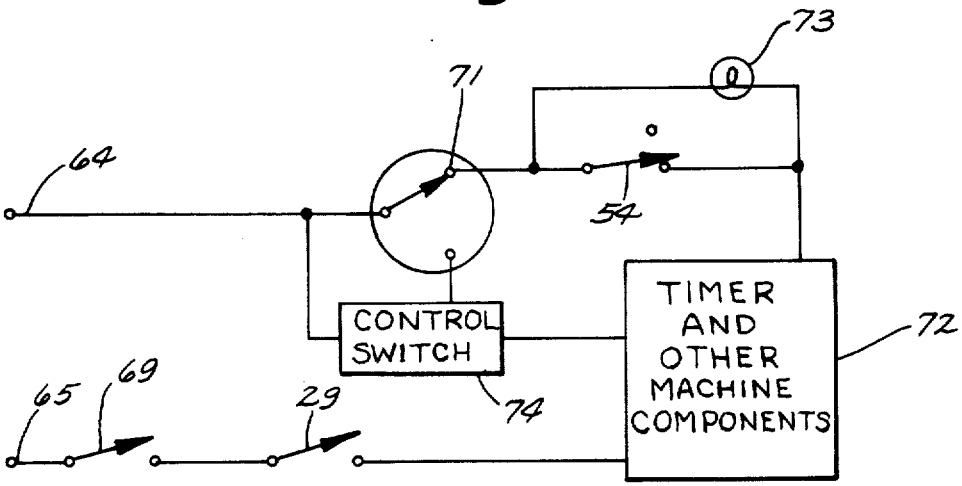
FIG. 5 is a partial schematic drawing of a second embodiment and showing the switching arrangement thereof.

FIG. 5 depicts an alternate embodiment of the energization circuit for a coin slide actuated commercial washing machine 10. Again, 120 VAC line voltage is provided between conductors 64 and 65. In this embodiment, the push-push switch 54 is in the fill circuit between the empty pressure switch contact 71 and the timer 16 which is schematically included in the rectangle 72. In this arrangement, a first insertion of the coin slide mechanism 12 opens the push-push switch 54 and configures the timer 16 for operation as the pivot arm 31 rotates the timer shaft 30 to close the line switch 29. A neon light 73 is mounted to the access door 15 as shown in FIG. 2. The neon light 73 is in parallel circuit connection with the push-push switch 54 and will be energized after the first insertion of the coin slide mechanism 12 to indicate that a second insertion of the coin slide mechanism 12 is required. The second insertion of the coin slide mechanism closes the push-push switch 54 and initiates the fill operation and operational cycle of the washing machine 10 through appropriate contacts within the timer 16 and control switch 74. The control switch 74 is a multi-contact switch for manually selecting desired water temperatures.

The operation of the coin slide system as shown herein may be briefly summarized as follows: closing the access lid 70 of the washing machine 10 will close the contacts of the lid switch 69. A first insertion of the coin slide mechanism 12 will effect contact of the wall segment 60 of the slide mounted actuator 41 with the end 40 of the actuator rod 35 and contact of the end 39 of the actuator rod 35 with the pivot arm 31 for rotationally advancing the timer shaft 30 in a clockwise direction to close the contacts of the line switch 29 and therefore condition the timer 16 for operation. The edge portion 61 of the slide mounted actuator 41 will contact the leg portion 51 of the actuation lever 50 and will rotate the cam portion 53 to open the contacts of the push-push switch 54. The push-push switch 54 and actuation lever 50 are positioned for actuation by the coin slide mechanism 12 so that the push-push switch 54 will make and reset while the coin slide mechanism 12 is in the ratcheted area (not shown) where the stroke direction of the coin slide mechanism 12 cannot be reversed. A second insertion of the coin slide mechanism 12 will again rotationally advance the pivot arm 31 on the timer shaft 30. However, the timer shaft 30 will not advance since the timer 16 is already in an operational condition and therefore the toothed segment 33 of the pivot arm 31 is effectively disengaged from the drive pin 34. The second insertion of the coin slide mechanism 12 will actuate and close the contacts of the push-push switch 54 to energize the timer 16 and other related machine components.

Although this embodiment of the invention has been shown applied to a commercial washing machine 10 it is understood that the double insertion or double actuation coin slide system disclosed herein utilizing a push-push switch 54 may be applied to any vending operation by a person skilled in the art.

There has thus been shown an improved coin slide system which requires double actuation to energize a vending operation through the use of a simple push-push switch mechanism.

In the drawings and specification, there has been set forth a preferred embodiment of the invention and although specific terms are employed these are used in a generic and descriptive sense only and not for purposes of limitation. Changes in form and the proportion of parts as well as the substitution of equivalents are contemplated as circumstances may suggest or render expedient without departing from the spirit or scope of the invention as further defined in the following claims.

I claim:

1. A double actuation coin slide system associated with a housing and operable for initiating an electrically energized vending operation, the combination comprising: a power source providing electrical power between a pair of electrical conductors for powering means for effecting said vending operation; first and second switch means associated with said electrical conductors, each of said first and second switch means being operable between power connecting first and power disconnecting second postures for cooperatively connecting or individually disconnecting electrical power from said power source to said vending effecting means with said first switch means being in said power disconnecting second posture during an off condition of said vending effecting means; and coin slide means mounted on said housing and movable from a coin receiving position to a position for initiating said vending operation, said coin slide means operable through a first coin slide insertion cycle for effecting actuation of said first switch means to said first posture and said second switch means to said power disconnecting second posture to maintain said power source disconnected from said vending effecting means and through a second coin slide insertion cycle for effecting actuation of said second switch means to said first posture while maintaining said first switch in said first posture to connect said power source and energize said vending effecting means whereby two coin slide insertion cycles are required for each vending operation.

2. A coin slide system as defined in claim 1 wherein said second switch means includes a push-push switch actuatable from a contact-closed to a contact-open posture and back to a contact-closed posture responsive to said first and second coin slide insertion cycles.

3. A coin slide system as defined in claim 1 wherein said housing includes means for mounting said second switch means and further includes means, intermediate said second switch means and an end of said coin slide means, for actuating said second switch means in response to said coin slide insertion cycles.

4. A double actuation coin slide system associated with a coin slide housing, the combination comprising: sequential control means associated with said coin slide housing and energizable for controlling a timed sequence of operations; a power source providing electrical power between a pair of electrical conductors for energizing said sequential control means; first and second switch means associated with said electrical conductors, each of said first and second switch means being operable between power connecting first and power disconnecting second postures and actuatable for cooperatively connecting or individually disconnecting electrical power from said power source to said sequential control means with said first switch means being in said power disconnecting second posture during an off condition of said sequential control means; and coin slide means mounted on said coin slide housing and movable from a coin receiving position to a position for rotationally advancing a shaft portion of said sequential control means, said coin slide means operable through a first coin slide insertion cycle for effecting actuation of said first switch means to said first posture and said second switch means to said power disconnecting second posture to maintain said power source disconnected from said sequential control means while conditioning said sequential control means for energization by advancing said shaft portion and through a subsequent second coin slide insertion cycle for effecting actuation of said second switch means to said first posture while maintaining said first switch in said first posture to connect said power source and energize said sequential control means whereby two coin slide insertion cycles are required for initiating a timed sequence of operations.

5. A coin slide system as defined in claim 4 wherein said second switch means includes a push-push switch actuatable from a contact-closed to a contact-open posture and back to a contact-closed posture responsive to said first and second coin slide insertion cycles.

6. A coin slide system as defined in claim 4 wherein said sequential control means includes said first switch means conditioned to a conductive posture responsive to said first coin slide insertion cycle.

7. A double actuation coin slide system associated with a coin slide housing and operable for initiating energization of a sequential controller across a power source to control a timed sequence of operations, the combination comprising: push-push switch means and line switch means associated with said power source, each of said push-push switch means and line switch means being operable between power connecting first and power disconnecting second postures for cooperatively connecting or individually disconnecting said power source to said sequential controller with said line switch means being in said power disconnecting second posture during an off condition of said sequential controller; and coin slide means mounted on said coin slide housing and movable from a coin receiving position to a position for mechanically actuating said sequential control means with a first insertion of said coin slide means advancing said sequential controller to condition said sequential controller for operation by actuating said line switch means to said power connecting first posture while substantially concurrently actuating said push-push switch to said power disconnecting second posture to disconnect said power source to said sequential controller and with a second insertion of said coin slide means actuating said push-push switch to said power connecting first posture to connect said power source to said sequential controller.

8. A double actuation coin slide system as defined in claim 7 and further including indicating means energizable after said first coin slide insertion for visually indicating that a second coin slide insertion is necessary for energization of said sequential controller and said sequence of operations.

* * * * *